US009555988B2

(12) United States Patent
Horiuchi

(10) Patent No.: US 9,555,988 B2
(45) Date of Patent: Jan. 31, 2017

(54) SHEET TAKEOUT DEVICE AND SHEET PROCESSING APPARATUS

(71) Applicant: Kabushiki Kaisha Toshiba, Tokyo (JP)

(72) Inventor: Haruhiko Horiuchi, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 14/830,499

(22) Filed: Aug. 19, 2015

(65) Prior Publication Data

US 2016/0052736 A1 Feb. 25, 2016

(30) Foreign Application Priority Data

Aug. 21, 2014 (JP) ..... 2014-168768

(51) Int. Cl.

| | |
|---|---|
| ***B65H 3/12*** | (2006.01) |
| ***B65H 5/22*** | (2006.01) |
| ***B65H 3/48*** | (2006.01) |
| ***B65H 3/14*** | (2006.01) |
| ***B65H 5/02*** | (2006.01) |
| ***B65H 5/06*** | (2006.01) |
| ***B65H 37/00*** | (2006.01) |
| ***B65H 39/00*** | (2006.01) |

(52) U.S. Cl.

CPC ..... *B65H 5/228* (2013.01); *B65H 3/124* (2013.01); *B65H 3/14* (2013.01); *B65H 3/48* (2013.01); *B65H 5/021* (2013.01); *B65H 5/06* (2013.01); *B65H 37/00* (2013.01); *B65H 39/00* (2013.01); *B65H 2406/122* (2013.01); *B65H 2701/1916* (2013.01)

(58) Field of Classification Search

CPC ..... B65H 3/12; B65H 3/124; B65H 3/48; B65H 2406/12

USPC ..... 271/97, 98

See application file for complete search history.

(56) References Cited

U.S. PATENT DOCUMENTS

| | | | |
|---|---|---|---|
| 8,827,261 | B2 | 9/2014 | Horiuchi |
| 2010/0329833 | A1 | 12/2010 | Ambroise et al. |

(Continued)

FOREIGN PATENT DOCUMENTS

| | | | |
|---|---|---|---|
| DE | 1203801 | B | 10/1965 |
| EP | 2141099 | A2 | 1/2010 |

(Continued)

OTHER PUBLICATIONS

Extended European Search Report issued in related European application No. 15181510.7, mailed on Dec. 21, 2015 (8 pages).

*Primary Examiner* — David H Bollinger

(74) *Attorney, Agent, or Firm* — Baker Botts L.L.P.

(57) ABSTRACT

A sheet takeout device has a feeding section, a takeout section, an air blowout section. The feeding section has a bottom wall with which one sides of a plurality of stacked sheets come in contact, and holds the plurality of sheets. The takeout section takes out the tipmost sheet by suction from the plurality of sheets, and sends out the tipmost sheet in a sending direction. The air blowout section blows out air toward between the one side of the sheet to be sucked by the takeout section and the one side of the sheet next to this sheet. The air blowout section has a first air blowout portion arranged at a position corresponding to a forward portion of the sheet in the sending direction, and a second air blowout portion arranged at a position corresponding to a backward portion of the sheet in the sending direction.

5 Claims, 6 Drawing Sheets

(56) References Cited

U.S. PATENT DOCUMENTS

| | | | | |
|---|---|---|---|---|
| 2012/0074639 | A1* | 3/2012 | Suzuki | B65H 3/128 271/5 |
| 2012/0223473 | A1* | 9/2012 | Watanabe | B65H 1/025 271/90 |
| 2014/0284867 | A1* | 9/2014 | Horiuchi | B65H 5/224 271/3.19 |

FOREIGN PATENT DOCUMENTS

| | | | |
|---|---|---|---|
| EP | 2639190 | A2 | 9/2013 |
| JP | 6-28504 | Y2 | 5/1988 |
| WO | 2008015347 | A1 | 2/2008 |

* cited by examiner

SHEET TAKEOUT DEVICE AND SHEET PROCESSING APPARATUS

CROSS-REFERENCE TO RELATED APPLICATION

This application is based upon and claims the benefit of priority from the prior Japanese Patent Application No. 2014-168768, filed on Aug. 21, 2014, the entire contents of which are incorporated herein by reference.

FIELD

Embodiments of the invention relate to a sheet takeout device and a sheet processing apparatus.

BACKGROUND

Conventionally, a sheet takeout device provided with a feeding section in which a plurality of sheets are filled in a stacked state, and a takeout section which takes out the sheets filled in the feeding section one by one by suction and sends out the sucked sheet, is known. In order to surely take out the sheets one by one by the takeout section, there is a case in which an air nozzle to blow out air toward the sheet is provided in the vicinity of the takeout section. And, air is blown to the stacked sheets, and thereby it is prevented that a tipmost sheet to be sucked by the takeout section and a next sheet adhere tightly to each other. By this means, the multi-sheet takeout of sheets by the takeout section is prevented.

Meanwhile, when the air blowout strength is increased in order to surely prevent the multi-sheet takeout of sheets by the takeout section, there has been a possibility that a sheet might be skewed by the moment acting on the sheet caused by blowing air to the sheet (a sheet might be tilted in the sending direction of the sheet).

In addition, sheets of various sizes are irregularly filled in the feeding section. For this reason, when a blowout hole of an air nozzle is arranged at a position which is determined based on a maximum size of the sheets, the blowout hole of the air nozzle might become farther, for a sheet of a smaller size. In such a case, it becomes difficult to effectively blow air to the sheets, and there has been a possibility that it becomes difficult to prevent the multi-sheet takeout of sheets by the takeout section.

EMBODIMENT TO PRACTICE THE INVENTION

A sheet takeout device of an embodiment has a feeding section, a takeout section, an air blowout section. The feeding section has a bottom wall with which one sides of a plurality of stacked sheets come in contact using own weights of the sheets, and holds the plurality of sheets. The takeout section takes out the tipmost sheet by suction from the plurality of sheet held in the feeding section, and sends out the tipmost sheet in a sending direction. The air blowout section blows out air toward between the one side of the sheet to be sucked by the takeout section and the one side of the sheet next to this sheet. In addition, the air blowout section is provided with at least a first air blowout portion which is arranged at a position corresponding to a forward portion of the sheet in the sending direction, and a second air blowout portion which is arranged at a position corresponding to a backward portion of the sheet in the sending direction.

Hereinafter, a sheet takeout device and a sheet processing apparatus of an embodiment will be described with reference to the drawings.

Figure 1:
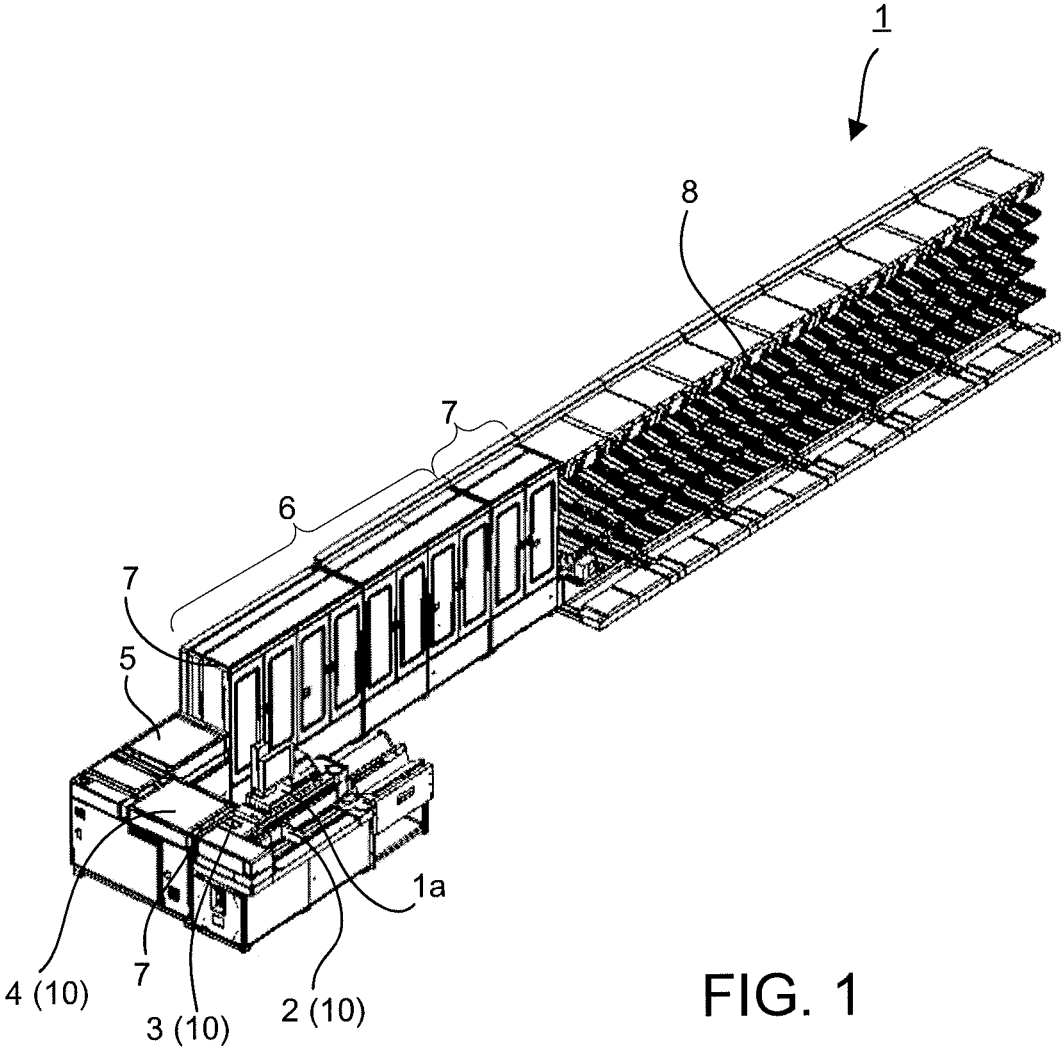
FIG. 1 is a perspective view showing a configuration of a sheet processing apparatus of an embodiment.

FIG. 1 is a perspective view showing a configuration of a sheet processing apparatus.

As shown in FIG. 1, a sheet processing apparatus 1 is provided with a controller 1*a*, a feeding section 2, a takeout and separation section 3, a main conveying path 4, an inspection section 5, a conveying and sorting section 6, gap correction sections 7 and sorting boxes 8.

The controller 1*a* totally controls an operation of the sheet processing apparatus 1.

The feeding section 2 holds a plurality of stacked sheets 100 (refer to FIG. 4) in an upright position in an approximately vertical direction with respect to a horizontal plane, and moves the plurality of sheets in a stacking direction, and feeds the plurality of sheets to the takeout and separation section 3 existing at a tip side of the stacking direction. The sheet is a letter, for example.

The takeout and separation section 3 sucks and takes out a tipmost sheet 100 in the stacking direction, out of the plurality of sheets 100 fed by the feeding section 2, and sends out the tipmost sheet 100 toward the main conveying path 4.

The inspection section 5 reads sorting information described on the sheet 100.

The conveying and sorting section 6 sorts the sheets 100 into four conveying paths which are provided in the vertical direction.

The gap correction sections 7 are provided immediately after the takeout and separation section 3, at an upstream portion of the conveying and sorting section 6, and immediately after the conveying and sorting section 6. The gap correction section 7 corrects an interval (gap) between adjacent sheets 100 in the conveying direction, so that the interval thereof becomes within a prescribed range.

The sorting boxes 8 are provided by four steps in the vertical direction. The sorting box 8 sorts and collects a sheet in accordance with the sorting information of the sheet.

Here, the feeding section 2, the takeout and separation section 3 and the main conveying path 4 compose a sheet takeout device 10.

Figure 2:
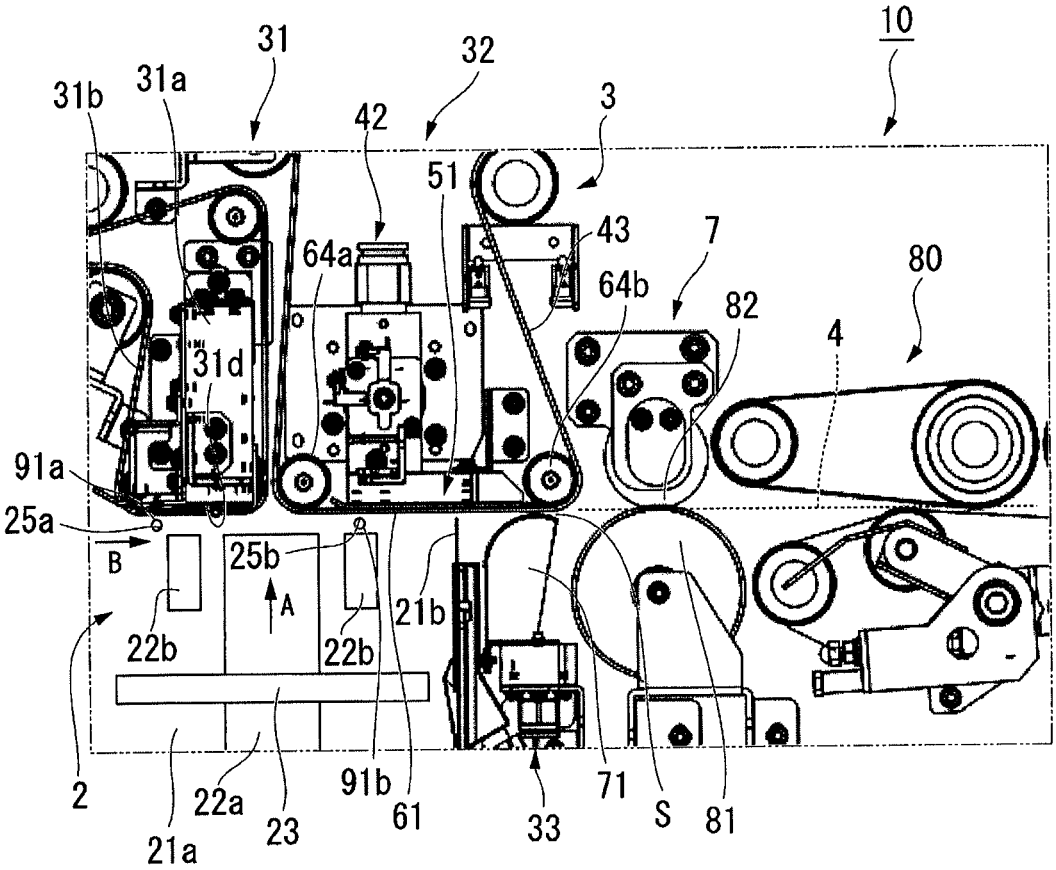
FIG. 2 is a plan view of the sheet takeout device of the embodiment.
Figure 3:
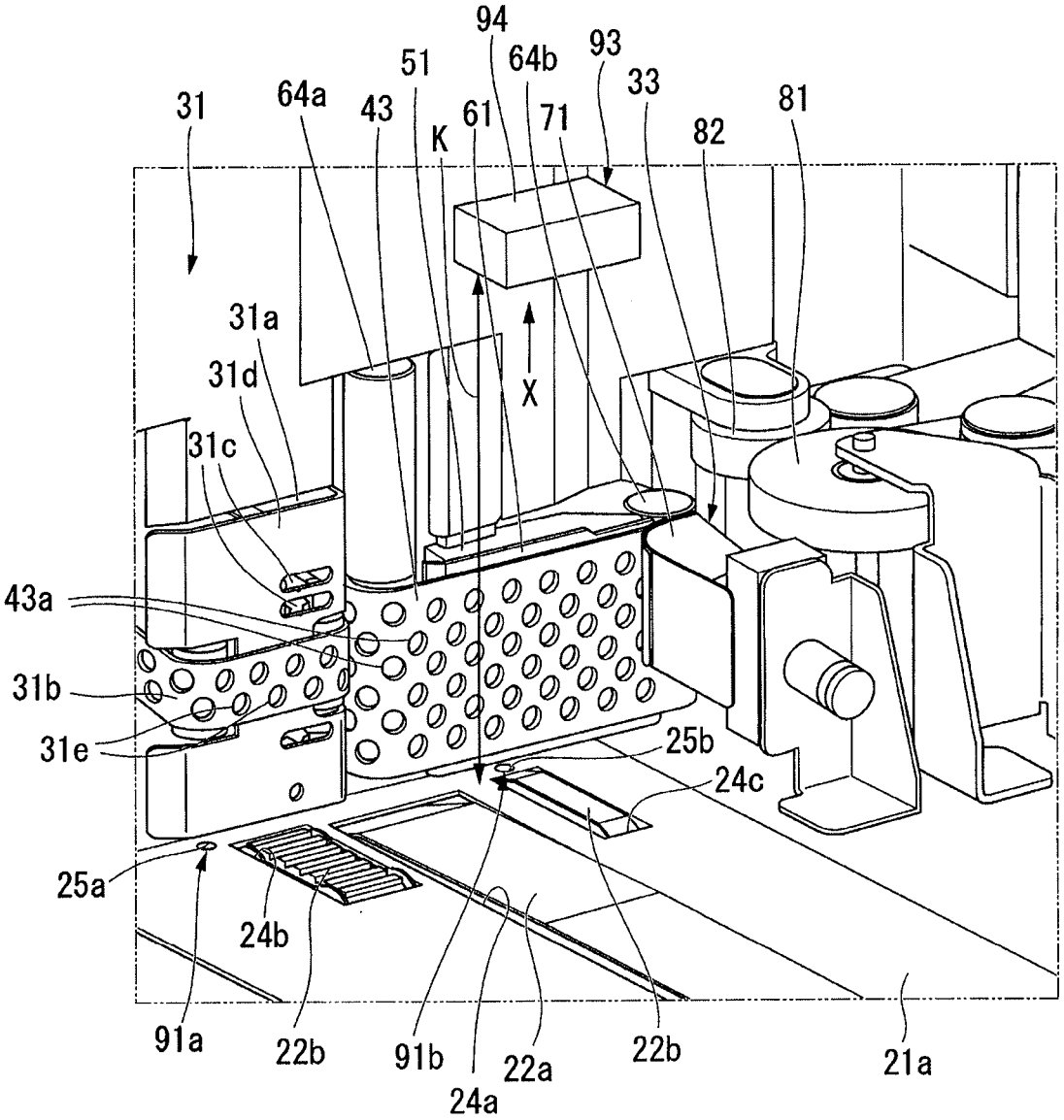
FIG. 3 is an enlarged perspective view of the feeding section of the embodiment and its periphery.
Figure 4:
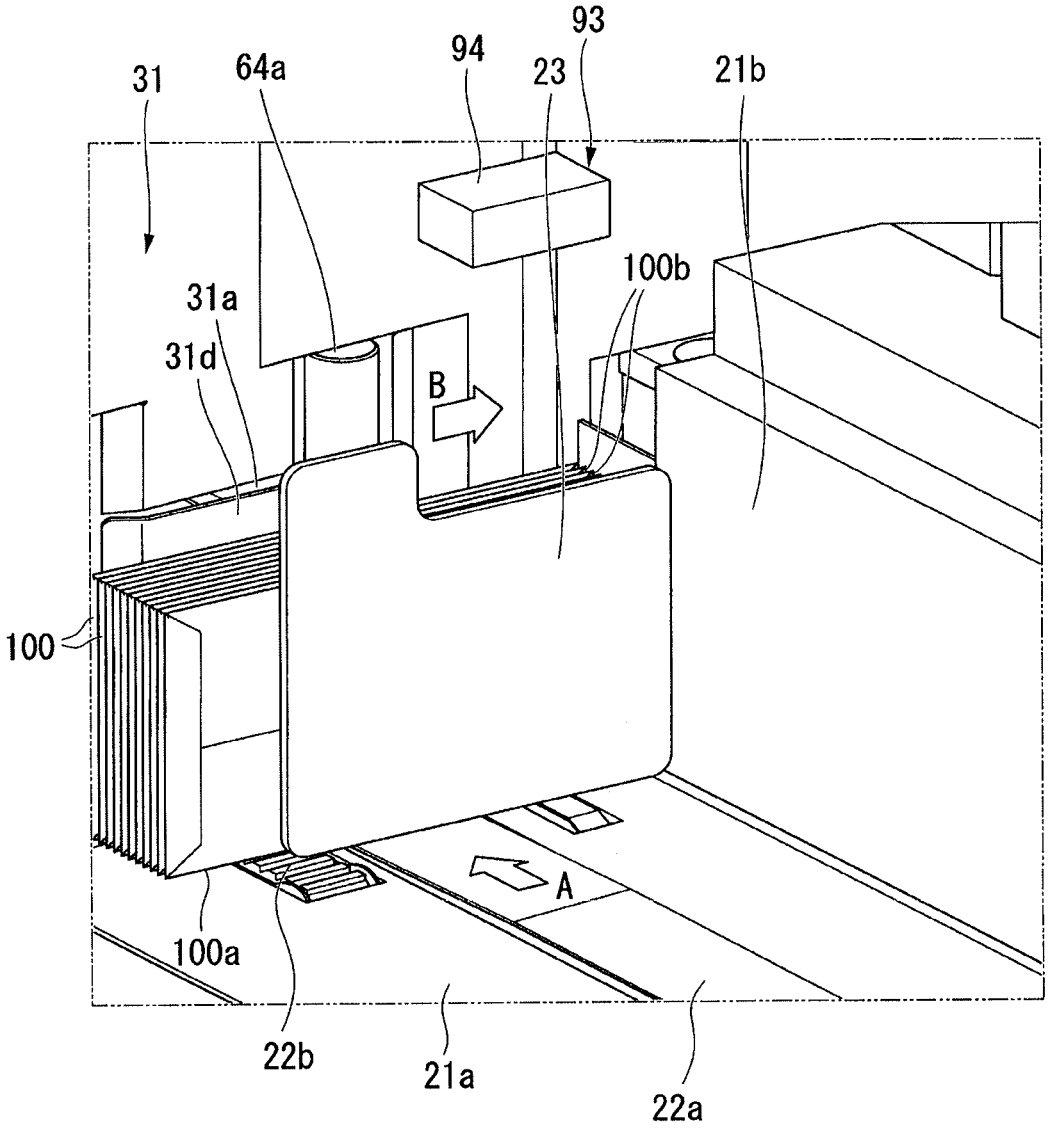
FIG. 4 is a perspective view showing a state in which sheets are arranged in the feeding section of the embodiment.

FIG. 2 is a plan view of the sheet takeout device, FIG. 3 is an enlarged perspective view of the feeding section and a periphery thereof, and FIG. 4 is a perspective view showing a state in which sheets are arranged in the feeding section.

As shown in FIG. 2-FIG. 4, the feeding section 2 of the sheet takeout device 10 is provided with a flat bottom wall 21*a*, and a guide wall 21*b* which rises approximately vertically from the bottom wall 21*a*. The feeding section 2 holds a plurality of stacked sheets 100 which are loaded on the bottom wall 21*a* in an upright position, so that the stacking direction of the plurality of sheets 100 coincides with a feeding direction A heading toward the takeout and separation section 3. The feeding section 2 guides the movement of the plurality of sheets 100, by the guide wall 21*b* which comes in contact with the respective end portions of the plurality of sheets 100 moving in the feeding direction A.

In addition, the feeding section 2 is provided with a main belt 22*a*, sub belts 22*b* which are provided on the bottom wall 21*a*, and a backup plate 23 which moves on the bottom wall 21*a* in the feeding direction A. The main belt 22*a* and the sub belts 22*b* come in contact with respective end portions of the plurality of sheets 100 loaded on the bottom wall 21*a*, and are mutually independently driven in the feeding direction A. By this means, the main belt 22 moves the plurality of sheets 100 loaded on the bottom wall 21*a* in the feeding direction A, and the sub belts 22*b* adjust a posture of each of the plurality of sheets 100.

In the bottom wall 21*a*, cutout portions 24*a*, 24*b*, 24*c* for exposing the main belt 22*a* and the sub belts 22*b* from on the bottom wall 21*a*, respectively.

The backup plate 23 comes in contact with a rearmost sheet 100 in the feeding direction A, out of the plurality of stacked sheets 100 arranged on the bottom wall 21*a*, and moves in synchronization with the driving of the main belt 22*a* so as to press out the plurality of sheets 100 in the feeding direction A. By this means, the backup plate 23 moves the plurality of sheets 100 loaded on the bottom wall 21*a* in the feeding direction A.

As shown in FIG. 4, in the sheet takeout device 10, the bottom wall 21*a* of the feeding section 2 forms a horizontal plane, and the guide wall 21*b* forms a vertical plane orthogonal to the horizontal plane. In each sheet 100 having a surface of a rectangular shape, the short direction is made approximately in parallel with the vertical direction, and an end portion (long side) 100*a* at the lower side in the vertical direction out of the both end portions in the short direction is supported by the surface of the bottom wall 21*a* forming the horizontal plane.

Each sheet 100 is arranged such that the long direction is made in parallel with the horizontal direction, an end portion (short side) at a sending direction B side of the takeout and separation section 3 described later, out of the both end portions in the long direction is butted against the guide wall 21*b*. By this means, in the plurality of sheets 100, the end portions (long side) 100*a* in the short direction at the lower side in the vertical direction come in contact with the bottom wall 21*a*, by their own weights, in the feeding section 2. That is, in the sheets 100, their end portions (long sides) 100*a* are aligned by the bottom wall 21*a*. In addition, in the plurality of sheets 100, the end portions (short sides) 100*b* in the long direction at the sending direction B side (that is, tip portions in the sending direction B) are aligned by the guide wall 21*b*.

Two air blowout portions 91*a*, 91*b* are provided in the bottom wall 21*a* of the feeding section 2. The two blowout portions 91*a*, 91*b* are arranged at the end portion of the downstream side of the feeding direction A, along the sending direction B, with an interval therebetween. In other words, the two air blowout portions 91*a*, 91*b* are arranged at positions corresponding to between the tipmost sheet 100 and the sheet 100 next to the tipmost sheet 100, out of the plurality of stacked sheets 100 arranged in the feeding section 2. That is, the two air blowout portions 91*a*, 91*b* blow out air toward between the end portion (long side) 100*a* of the tipmost sheet 100 and the end portion (long side) 100*a* of the sheet 100 next to the tipmost sheet 100.

The air blowout portions 91*a*, 91*b* will be described in more detail based on FIG. 3-FIG. 5.

Figure 5:
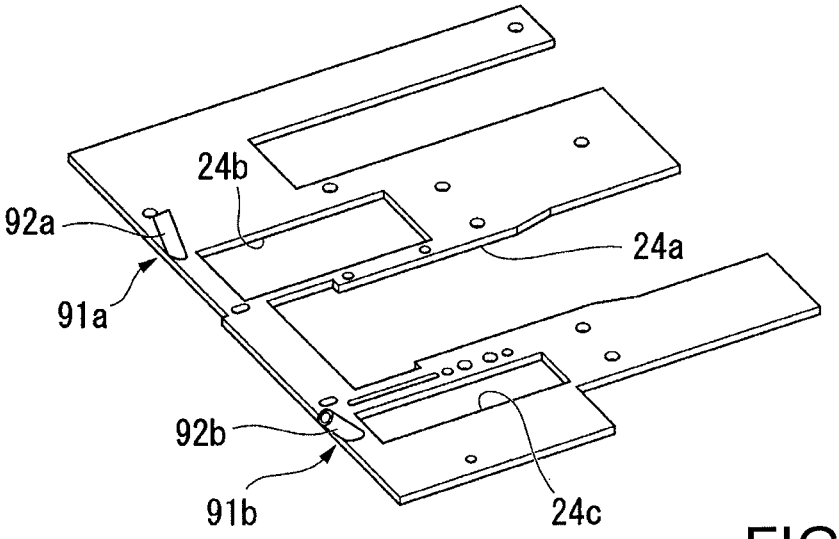
FIG. 5 is a perspective view of the bottom wall of the embodiment seen from the rear face.

FIG. 5 is a perspective view of the bottom wall which is seen from the rear face (a face at the opposite side of a face with which the sheet comes in contact (hereinafter, referred to as a front face)).

As shown in FIG. 3-FIG. 5, the two air blowout portions 91*a*, 91*b* are ones for preventing that the tipmost sheet 100 and the sheet 100 next to the tipmost sheet 100, out of the plurality of stacked sheets 100 arranged in the feeding section 2, might be overlapped and tightly adhere to each other. The two air blowout portions 91*a*, 91*b* are provided with air nozzles 92*a*, 92*b* which are coupled with two openings 25*a*, 25*b* formed in the bottom wall 21*a*, respectively.

The opening 25*a* is located at a more upstream side of the sending direction B than the opening 25*b*. The opening 25*a* is formed at a position corresponding to a corner portion of the sheet 100 of the minimum size, out of the stacked sheets 100 arranged in the feeding section 2. In addition, the opening 25*b* is formed at a position of a slightly front side of the guide wall 21*b* (the upstream side of the sending direction B). Here, the sheet of the minimum size is a sheet whose size is the minimum among the sheets which the sheet takeout device and the sheet processing apparatus deal with.

In each of the air nozzles 92*a*, 92*b*, a tip end thereof is connected to the bottom wall 21*a*, and a base end thereof projects from the rear face side of the bottom wall 21*a*. The base end of each of the air nozzles 92*a*, 92*b* is connected to an air pump (not shown). By this means, air is blown out from the openings 25*a*, 25*b* of the bottom wall 21*a*, via the air nozzle 92*a*, 92*b*, respectively.

The first air blowout portion 91*a* is located at a more upstream side of the sending direction B than the second air blowout portion 91*b*. The first air nozzle 92*a* of the first air blowout portion 91*a* is obliquely arranged so as to gradually head toward the downstream side of the sending direction B as it heads toward the front face of the bottom wall 21*a* from the rear face. By this means, air is blown out from the opening 25*a* of the bottom wall 21*a*, toward the center of gravity of the sheet 100 from the end portion 100*a* in the short direction at the lower side in the vertical direction in the sheet 100.

The second air nozzle 92*b* of the second air blowout portion 91*b* is obliquely arranged so as to gradually head toward the upstream side of the feeding direction A as it heads toward the front face of the bottom wall 21*a* from the rear face. By this means, air is blown out from the opening 25*b* of the bottom wall 21 in a direction so as to make the sheet 100 next to the tipmost sheet 100 to be separated from the tipmost sheet 100.

In addition, as shown in FIG. 3, FIG. 4, a blowup preventing portion 93 is provided in the feeding section 2 so as to face the end portion (a place where the air blowout portions 91*a*, 91*b* are formed) of the bottom wall 21*a* at the downstream side of the feeding direction A, in the vertical direction. The blowup preventing portion 93 is one for preventing the blowup of the sheet 100 caused by the air blowout portions 91*a*, 91*b*. An interval K between the bottom wall 21*a* and the blowup preventing portion 93 is set larger than a width in the short direction of the maximum size in the sheet 100.

Figure 6:
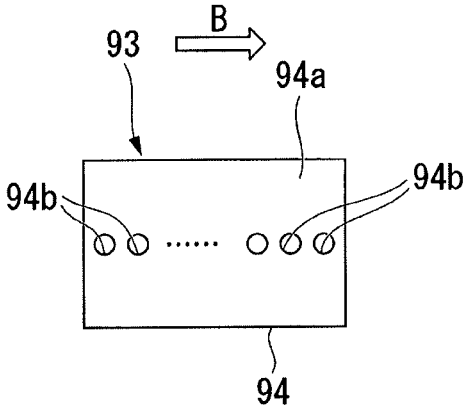
FIG. 6 is a view of FIG. 3 seen in the direction of an arrow X.

FIG. 6 is a view of FIG. 3 seen in the direction of an arrow X.

As shown in FIG. 3, FIG. 4 and FIG. 6, the blowup preventing portion 93 is provided with an air chamber 94. The air chamber 94 is fixed to the wall portion and so on at the takeout and separation section 3 side, and thereby the air chamber 94 faces the bottom wall 21*a* in the vertical direction. A plurality of blowout holes 94*b* are arranged along the sending direction B in one face 94*a* at the bottom wall 21*a* side of the air chamber 94. In addition, an air pump (not shown) is connected to the air chamber 94. For this reason, the air chamber 94 is filled with air, and further the air is blown out from the respective blowout holes 94*b*. Since the blown out air presses the sheet 100, the blowup of the sheet 100 can be prevented.

Here, a setting method of air pressures (blowout forces of air) of the air blowout portions 91*a*, 91*b*, and the blowup preventing portion 93, and a setting method of positions of the respective openings 25*a*, 25*b* of the air blowout portions 91*a*, 91*b*, and the blowout holes 94*b* of the blowup preventing portion 93 will be described more in detail, based on FIG. 7.

Figure 7:
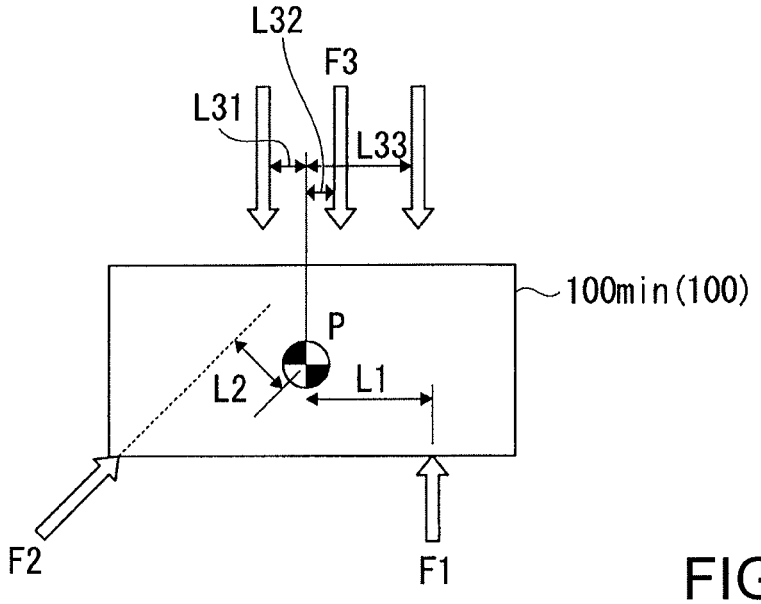
FIG. 7 is an explanation diagram indicating a setting method of each air pressure and positions of each opening and each blowout hole of the embodiment.

FIG. 7 is an explanation diagram indicating a setting method of each air pressure, and a setting method of the positions of each opening and each blowout hole. In addition, in FIG. 7, in order to simplify the description, a case will be described in which the number of the blowout holes 94 is three, and the position of the one blowout hole 94*b* out of these is located at a more upstream side in the sending direction than the center of gravity P of a sheet 100min of the minimum size. However, the number and arrangement of the blowout holes 94*b* are not limited to the above-described ones, but they can be optionally set on the air chamber 94.

As shown in FIG. 7, each air pressure and the positions of each opening and each blowout hole are set based on the sheet 100min of the minimum size. That is, when it is assumed that the center of gravity of the sheet 100min of the minimum size is P, a distance between an air blowout direction in the second air nozzle 92*b* and the center of gravity P is L1, an air pressure of the second air nozzle 92*b* is F1, a distance between an air blowout direction in the first air nozzle 92*a* and the center of gravity P is L2, an air pressure of the first air nozzle 92*a* is F2, distances between air blowout directions in the respective blowout holes 94*b* and the center of gravity P are L31, L32, L33, and an air pressure of the blowout hole 94*b* is F3, the respective air pressures F1-F3, and the positions of the respective openings 25*a*, 25*b*, and the respective blowout holes 94*b* are set so as to satisfy $$F1\times L1+F3\times L31=F2\times L2+F3\times(L32+L33) \quad (1)$$

By setting as described above, a moment M applied to the sheet 100min of the minimum size by the respective air pressures F1-F3 can be set to 0.

In addition, the reason that each air pressure, the positions of each opening and each blowout hole are set based on the sheet 100min of the minimum size is because the weight of the sheet 100min of the minimum size is the lightest and the sheet 100min is susceptible to the effect of being blown by air. The effect of the air blowing force to the sheet 100min of the minimum size is suppressed, and thereby it is possible to suppress the effect of the air blowing force even to a sheet 100 with a larger size as far as possible.

Returning to FIG. 2 and FIG. 3, the takeout and separation section 3 is provided with a sub takeout portion 31, a main takeout portion 32, a separation portion 33.

The sub takeout portion 31 is arranged at a more upstream side than the main takeout portion 32 in the sending direction B that is in parallel with the horizontal direction. The sub takeout portion 31 is provided with a sub air chamber 31*a* connected to a negative pressure generator (not shown. a suction side of a blower, for example), and a suction belt 31*b* driven by a drive motor (not shown. a step motor, for example).

The sub air chamber 31*a* is provided with a sub guide plate 31*d* formed with a plurality of openings 31*c* which are opened toward the feeding section 2. The sub guide plate 31*d* is of a rectangular plate shape, and the plurality of openings 31*c* are communicated with the inside of the sub air chamber 31*a*. By this means, a negative pressure (a pressure lower than the atmospheric pressure) is given to the openings 31*c* of the sub guide plate 31*d*. The sub guide plate 31*d* guides the movement of the suction belt 31 in the sending direction B.

The suction belt 31*b* is an endless belt formed with a plurality of suction holes 31*e*, and is arranged such that at least a part of the region of the suction belt 31*b* overlaps with a part of the sub guide plate 31*d*. At the region of the suction belt 31*b* where it overlaps with the sub guide plate 31*d*, a plurality of the suction holes 31*e* of the suction belt 31*b* communicate with at least a part of a plurality of the openings 31*c* of the sub guide plate 31*d*. By this means, a negative pressure is given to a plurality of the suction holes 31*e* of the suction belt 31*b* by the sub air chamber 31*a* via a plurality of the openings 31*c*.

In the suction belt 31*b*, the region where it overlaps with the sub guide plate 31*d* faces the plurality of sheets 100 held in the feeding section 2 in the feeding direction A, and the suction belt 31*b* moves in the sending direction B, in the state that the suction belt 31*b* is arranged so as to extend in parallel with the sending direction B. By this means, when a negative pressure is given to a plurality of the suction holes 31*e*, the suction belt 31*b* takes out a tipmost sheet 100 in the feeding direction A by suction, from the plurality of sheets 100 fed by the feeding section 2. And the suction belt 31*b* sends out the sheet 100 taken out by suction in the sending direction B at a prescribed speed.

The prescribed speed of the suction belt 31*b* is set slower than a speed of a takeout belt 43 described later. By this means, the sub takeout portion 31 takes out a first sheet 100 from the feeding section 2 by suction, and sends out the first sheet 100 to the main takeout portion 32, and in addition, takes out a second sheet by suction after the back end of the first sheet 100 has passed through the sub air chamber 31*a*.

And, the sub takeout portion 31 sends out the second sheet to the main takeout portion 32 at a speed slower than the speed at which the first sheet is sent out in the sending direction B by the main takeout portion 32. By this means, an interval not less than a prescribed interval value is provided between the first sheet and the second sheet in the sending direction B, to resolve the overlapping of the first sheet and the second sheet.

The main takeout portion 32 is arranged at the downstream side of the sub takeout portion 31 in the sending direction B. The main takeout portion 32 is provided with a valve device 42, the takeout belt 43 which is driven by a drive motor (not shown. a step motor, for example).

The valve device 42 is provided with a main body block 51 formed with a plate-like main guide plate 61 on one surface thereof. The main body block 51 is arranged so that the main guide plate 61 faces the plurality of sheets held in the feeding section 2 in the feeding direction A. The main guide plate 61 guides the movement of the takeout belt 43 in the sending direction B.

In the main body block 51 and the main guide plate 61, a plurality of through holes (not shown) which communicate between them is formed. These through holes are connected to a vacuum pump (not shown) provided in the valve device 42. By this means, a negative pressure is given to the through holes of the main body block 51 and the main guide plate 61.

The takeout belt 43 is an endless belt in which a plurality of suction holes 43*a* are uniformly formed over the entire region thereof, and the takeout belt 43 is wound around a plurality of pulleys (not shown) including two pulleys 64*a*, 64*b* which are respectively arranged at the both sides of the valve device 42 in the sending direction B. The takeout belt 43 is arranged so that at least a part of the region thereof overlaps with the main guide plate 61. A plurality of the suction holes 43*a* of the takeout belt 43 communicate with the through holes (not shown) formed in the main guide plate 61 at the region of the takeout belt 43 where it overlaps with the main guide plate 61. By this means, a negative pressure is given to a plurality of the suction holes 43*a* of the takeout belt 43.

In addition, the takeout belt 43 moves in the sending direction B, in the state that the region of the takeout belt 43 where it overlaps with the main guide plate 61 extends in parallel with the sending direction B. By this means, when a negative pressure is given to a plurality of the suction holes 43*a*, the takeout belt 43 takes out a sheet by suction which is fed in the feeding direction A by the feeding section 2, and is sent out in the sending direction B by the sub takeout portion 31. And, the takeout belt 43 sends out the sheet taken out by suction in the sending direction B, at a speed higher than the sending speed by the sub takeout portion 31. At this time, the guide wall 21*b* of the feeding section 2 guides the sending of the sheet in the sending direction B by the takeout belt 43.

As shown in FIG. 2 and FIG. 3, the separation portion 33 is arranged at an opposite side of the main takeout portion 32, with respect to a sheet sent out in the sending direction B by the main takeout portion 32, at the downstream side of the guide wall 21*b* of the feeding section 2 in the sending direction B. The separation portion 33 is provided with a double-sheet takeout preventing block 71. The double-sheet takeout preventing block 71 is arranged so as to face the takeout belt 43 through a gap S therebetween, at a downstream side in the sending direction B. The gap S is set to about 0.5 mm, for example.

Figure 8:
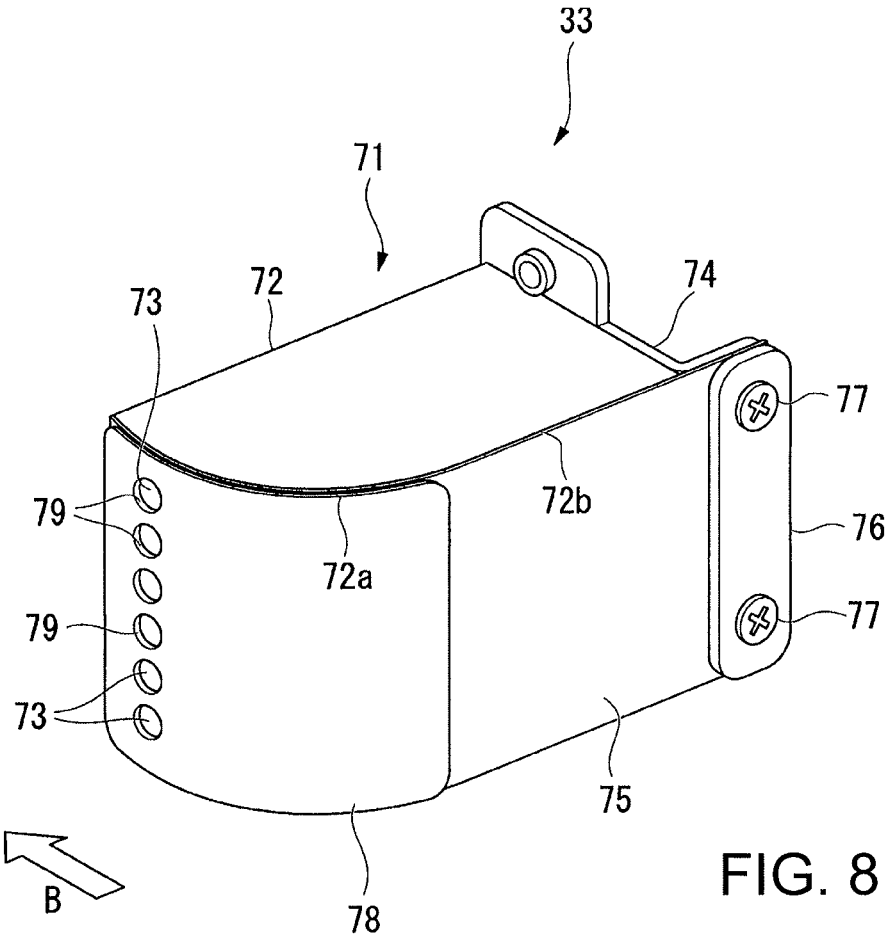
FIG. 8 is a perspective view of the double-sheet takeout preventing block of the embodiment.

FIG. 8 is a perspective view of the double-sheet takeout preventing block.

As shown in FIG. 8, when a plurality of sheets are taken out by the takeout belt 43 simultaneously, the double-sheet takeout preventing block 71 sucks a sheet at the double-sheet takeout preventing block 71 side, to stop the movement of the sheet. By this means, the double-sheet takeout preventing block 71 functions so as not to send a plurality of sheets into the gap correction section 7 simultaneously.

The double-sheet takeout preventing block 71 has a main body portion 72 formed of elastic material such as urethane rubber (rubber material), for example. The main body portion 72 is formed of elastic material, and thereby the main body portion 72 can be lightened, and also it is possible to shorten a time for the main body portion 72 to return to the original shape, after the main body portion 72 has been deformed caused by the entering of the sheet 100.

The main body portion 72 is formed into an arc surface 72*a*, at the takeout belt 43 side (tip side), and also at the entering side (an upstream side in the sending direction B) of the sheet 100.

A plurality (6, for example) of suction holes 73 are formed at a position closest to the takeout belt 43 of the arc surface 72*a*, that is, at a tip of the arc surface 72*a*. These suction holes 73 are arranged along a direction orthogonal to the sending direction B with equal intervals. Each suction hole 73 is connected to a negative pressure generator (not shown. a vacuum pump, for example) provided in the separation portion 33. By this means, a negative pressure is given to each suction hole 73.

At a base end side (an opposite side of the arc surface 72*a*) of the main body portion 72, a base plate 74 for fixing the main body portion 72 to the sheet takeout device 10 is provided. In addition, on the arc surface 72*a* of the main body portion 72, and a side surface 72*b* connecting to the arc surface 72*a*, a support plate 75 is provided so as to cover the arc surface 72*a* and the side surface 72*b*.

The base plate 74 and the support plate 75 are respectively fixed to the main body portion 72 using bonding agent or the like. In addition, a base end side of the support plate 75 is fixed to the base plate 74 via a fixing plate 76 and bolts 77.

The support plate 75 has a role to prevent that the main body portion 72 is torn off from the base plate 74 due to the shock when the sheet 100 enters, and has a role of a support so that the main body portion 72 returns to the original shape after the main body portion 72 has been deformed. In addition, stainless steel is preferable for the material of the support plate 75. Stainless steel is used, and thereby elasticity and rust prevention of the support plate 75 can be ensured. In addition, a wall thickness of the support plate 75 is set to about 0.1 mm, for example, so that the support plate 75 does not affect the deformation of the main body portion 72 as far as possible.

Further, a protection cover 78 is provided on the surface of the support plate 75 at a position corresponding to the arc surface 72*a* of the main body portion 72. The protection cover 78 is used for preventing the deterioration, abrasion of the main body portion 72 and the support plate 75 due to the shock when a sheet enters.

The protection cover 78 is formed of a metal plate such as a stainless steel plate. A wall thickness of the protection cover 78 is set to about 1 mm, for example. With the configuration like this, the protection cover 78 can follow the deformation of the main body portion 72. In addition, in the support plate 75 and the protection cover 78, suction holes 79 are respectively formed at the positions corresponding to the suction holes 73 of the main body portion 72. By this means, a negative pressure is given to the suction holes 79 of the protection cover 78 via the suction holes 73 of the main body portion 72.

Returning to FIG. 2 and FIG. 3, the gap correction section 7, along with a plurality of various conveying belts and rollers (not shown), composes a part of a conveying mechanism 80 which conveys a sheet. The gap correction section 7 is arranged at a downstream side of the separation portion 33 in the sending direction B. The gap correction section 7 is provided with a sponge roller 81 and a drive roller 82 which are arranged so as to sandwich the main conveying path 4 therebetween. The sponge roller 81 is a soft roller having elasticity, and deforms in accordance with the change in a thickness of a sheet to be conveyed in the main conveying path 4.

The drive roller 82 is rotationally driven by a drive motor (not shown. an AC servo motor, for example), and changes a conveying speed of the sheet 100 by acceleration/deceleration of the rotation. By this means, when an interval (gap) between the sheet 100 which has been sandwiched by the sponge roller 81 and the drive roller 82, and the sheet 100 preceding in the conveying direction is smaller than a specified value, the gap correction section 7 decelerates the conveying speed of the sheet 100, to broaden the interval. On the other hand, when an interval between the sheet 100 which has been sandwiched by the sponge roller 81 and the drive roller 82, and the sheet 100 preceding in the conveying direction is larger than a specified value, the gap correction section 7 accelerates the conveying speed of the sheet 100, to shorten the interval.

Next, an operation of the air blowout portions 91*a*, 91*b*, and the blowup preventing portion 93 will be described.

The air blowout portions 91*a*, 91*b*, and the blowup preventing portion 93 operate based on a detection result of a sheet presence/absence sensor (not shown) provided in the feeding section 2. That is, when it is detected by the sheet presence/absence sensor (not shown) that a plurality of sheets are arranged in the feeding section 2, air is blown out from the air blowout portions 91*a*, 91*b*, and the blowup preventing portion 93 toward the sheet 100.

Here, in the plurality of sheets 100, the end portions 100*a* of the short direction at the lower side in the vertical direction come in contact with the bottom wall 21*a* by their own weights in the feeding section 2, and the end portions 100*a* are aligned by this bottom wall 21*a*. For this reason, the air comes to be blown to the sheet 100 from immediately close to the end portion 100*a*, by the two air blowout portions 91*a*, 91*b*, irrespective of its size. For the reason, the air blown out from the two air blowout portions 91*a*, 91*b* constantly enters between the tipmost sheet 100 and the sheet 100 next to the tipmost sheet 100 which are arranged in the feeding section 2, by a prescribed blowing force.

In addition, the opening 25*a* is formed at a position corresponding to a corner portion of the sheet 100 of the minimum size, and the opening 25*b* is formed at a position slightly in the front of the guide wall 21*b* (an upstream side in the sending direction B of the sheet 100). For the reason, air evenly enters between the tipmost sheet 100 and the sheet 100 next to the tipmost sheet 100 which are arranged in the feeding section 2.

Accordingly, it can be prevented that two overlapping sheets 100 are sent out by the takeout and separation section 3.

In addition, since the blowup preventing portion 93 is provided in the feeding section 2, air is blown from above, by the blowup preventing portion 93, to the sheet 100 to which air is blown by the two air blowout portions 91*a*, 91*b*. For the reason, the blowup of the sheet 100 can be prevented.

Here, the air pressures F2, F1 of the air blown out from the two air blowout portions 91*a*, 91*b*, the air pressure F3 of the air blown out from the blowup preventing portion 93, and the positions of the two air blowout portions 91*a*, 91*b* and the blowup preventing portion 93 are set so as to satisfy the expression (1). For the reason, the moment M applied to the sheet 100 by the blown air can be reduced as far as possible, and it can be prevented that the sheet 100 might be skewed by air.

In this manner, in the feeding section 2 of the present embodiment, the two air blowout portions 91*a*, 91*b* are provided in the bottom wall 21*a* on which the end portions 100*a* of the sheets 100 are aligned. For the reason, it is possible to blow air to the sheet 100 from immediately close to the end portion 100*a* by the two air blowout portions 91*a*, 91*b*, irrespective of the size of the sheet 100. Since the air blowout portion 91*b* is arranged at a position corresponding to a forward portion of the sheet 100 in the sending direction B, and the air blowout portion 91*a* is arranged at a position corresponding to a backward portion of the sheet 100 in the sending direction B, it is possible to make air evenly enter between the two sheets 100. The forward portion of the sheet 100 in the sending direction B means a front half portion of the sheet 100 of the minimum size in the sending direction B. The backward portion of the sheet 100 in the sending direction B means a back half portion of the sheet 100 of the minimum size in the sending direction B.

For the reason, it is possible to surely prevent that the sheets 100 which are to be sucked by the takeout and separation section 3 might be sucked and sent out in the state that the two sheets 100 are overlapped with each other.

In addition, since it becomes unnecessary to uselessly increase the air pressures of the two air blowout portions 91*a*, 91*b*, it can be prevented that the sheet 100 might be skewed by the blown air.

In addition, the air nozzles 92*a*, 92*b* of the two air blowout portions 91*a*, 91*b* are directly fitted to the bottom wall 21*a*, it is possible to surely blow air to a desired position of the sheets 100 (between the tipmost sheet 100 and the sheet 100 next to the tipmost sheet 100 which are arranged in the feeding section 2).

Further, since it is not necessary to specially fix the air nozzles 92*a*, 92*b*, the increase in the number of the components can also be suppressed. For this reason, it is possible to suppress the increase in manufacturing cost caused by providing the two air blowout portions 91*a*, 91*b*.

The air blowout portion 91*a* is located at a more upstream side of the sending direction B than the air blowout portion 91*b*. The first air nozzle 92*a* of the first air blowout portion 91*a* is obliquely arranged so as to gradually head toward the downstream side of the sending direction B as it heads toward the front face of the bottom wall 21*a* from the rear face. By this means, the first air nozzle 92*a* can blow air from the opening 25*a* of the bottom wall 21*a* toward the center of gravity of the sheet 100. Accordingly, it is possible to make air effectively enter between the two sheets 100, and it can surely be prevented that the two overlapping sheets 100 might tightly adhere to each other.

The second air nozzle 92*b* of the second air blowout portion 91*b* is obliquely arranged so as to gradually head toward the upstream side of the feeding direction A as it heads toward the front face of the bottom wall 21*a* from the rear face. For the reason, it is possible to blow out air from the opening 25*b* of the bottom wall 21*a* toward a direction so as to make the sheet 100 next to the tipmost sheet 100 to be separated from the tipmost sheet 100. For the reason, it can be more surely prevented that the two overlapping sheets 100 might tightly adhere to each other.

And, the air pressures F2, F1 of the air blown out from the two air blowout portions 91*a*, 91*b*, the air pressure F3 of the air blown out from the blowup preventing portion 93, and the positions of the two air blowout portions 91*a*, 91*b* and the blowup preventing portion 93 are set so as to satisfy the expression (1). That is, the respective air pressures F1-F3, and the positions of the respective openings 25*a*, 25*b* formed in the bottom wall 21*a* and the respective blowout holes 94*b* of the blowup preventing portion 93 are set so that the moment M applied to the sheet 100min of the minimum size by the air becomes 0. As a result, it is possible to reduce the moment M applied to the sheets 100 except the sheet 100min of the minimum size by the air as far as possible. For the reason, it is can surely be prevented that the sheet 100 might be skewed by the air.

In addition, the blowup preventing portion 93 is provided in the feeding section 2, and thereby it is possible to prevent that the sheet 100 might be blown up by the two air blowout portions 91, 91*b*. For this reason, it can be prevented that the posture of the stacked sheets 100 arranged in the feeding section 2 might be disturbed.

Further, since a configuration in which air is blown out is adopted as the blowup preventing portion 93, it is possible to prevent the blowup of this sheet 100, irrespective of the size of the sheet 100.

Further, in the above-described embodiment, the case that the two air blowout portions 91*a*, 91*b* are provided in the bottom wall 21*a* of the feeding section 2 has been described. But, the number of the air blowout portions is not limited to this, and it is only necessary that at least one air blowout portion is provided. In this case, it is preferable to configure the device such that an air blowout portion is provided near the approximate center in the end portion 100*a* at the lower side in the vertical direction of the sheet 100, and thereby air is blown toward the center of gravity of the sheet 100. More specifically, it is preferable to provide an air blowout portion so as to blow air toward the center of gravity of the sheet 100min of the minimum size.

In addition, in the above-described embodiment, the case that the blowup preventing portion 93 is configured to blow air toward the sheet 100 has been described. But the configuration of the blowup preventing portion is not limited to this, and a guide to block the blowup of the sheet 100 is provided, and this guide may be configured as the blowup preventing portion. In this case, the position of the guide is set based on the maximum size of the sheets 100. By this means, it can be prevented that the sheet 100 comes in contact with the guide and might be bent.

In addition, when the blowup preventing portion is composed of a guide, the air pressures F2, F1 of the two air blowout portions 91*a*, 91*b*, and the positions of the air blowout portions 91*a*, 91*b* are set so that the moment M applied to the sheet 100 by only the two air blowout portions 91*a*, 91*b* becomes 0.

That is, when it is assumed that the center of gravity of the sheet 100min of the minimum size is P, a distance between an air blowout direction in the second air nozzle 92*b* and the center of gravity P is L1, an air pressure of the second air nozzle 92*b* is F1, a distance between an air blowout direction in the first air nozzle 92*a* and the center of gravity P is L2, an air pressure of the first air nozzle 92*a* is F2, the respective air pressures F1, F2, and the respective positions of the openings 25*a*, 25*b* which are formed in the bottom wall 21*a* are set so as to satisfy $$F2 \times L2 = F1 \times L1 \quad (2)$$

In addition, in the above-described embodiment, the case has been described that the air blowout portions 91*a*, 91*b*, and the blowup preventing portion 93 operate based on a detection result of the sheet presence/absence sensor (not shown) provided in the feeding section 2. But the operation of the air blowout portions 91*a*, 91*b*, and the blowup preventing portion 93 is not limited to this, and the air blowout portions 91*a*, 91*b*, and the blowup preventing portion 93 may be operated all times. Further, the operation timings of the air blowout portions 91*a*, 91*b*, and the blowup preventing portion 93 may be determined, in synchronization with the operation timings of the main belt 22*a* and the sub belts 22*b* which are provided on the bottom wall 21*a*, for example. That is, it is only necessary that the device is configured such that air is blown between the tipmost sheet 100 and the sheet 100 next to the tipmost sheet 100, immediately before the sheet 100 is sucked by the takeout and separation section 3.

According to the above-described embodiment, the two air blowout portions 91*a*, 91*b* are provided in the bottom wall 21*a* where the end portions 100*a* of the sheets 100 are aligned. For this reason, it is possible to blow air to the sheets 100 from immediately close to the end portions 100*a* by the two air blowout portions 91*a*, 91*b*, irrespective of the size of the sheet 100. In addition, since the air blowout portion 91*b* is arranged at a position corresponding to the forward portion of the sheet 100 in the sending direction B, and the air blowout portion 91*a* is arranged at a position corresponding to the backward portion of the sheet 100 in the sending direction B, it is possible to make air evenly enter between the two sheets 100.

For the reason, it is possible to surely prevent that the sheets 100 which are to be sucked by the takeout and separation section 3 are sucked and sent out in the state that the two sheets are overlapped with each other.

In addition, since it becomes unnecessary to uselessly increase the air pressures of the two air blowout portions 91*a*, 91*b*, it can be prevented that the sheet 100 might be skewed by the blown air.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A sheet takeout device, comprising:

a feeding section having a bottom wall with which one sides of a plurality of stacked sheets come in contact using own weights of the relevant sheets, which holds the plurality of sheets;

a takeout section which takes out the tipmost sheet by suction from the plurality of sheet held in the feeding section, and sends out the tipmost sheet in a sending direction; and an air blowout section which blows out air toward between the one side of the sheet to be sucked by the takeout section and the one side of the sheet next to the sheet to be sucked;

wherein the air blowout section including at least a first air blowout portion which is arranged at a position corresponding to a forward portion of the sheet in the sending direction, and a second air blowout portion which is arranged at a position corresponding to a backward portion of the sheet in the sending direction, wherein the air blowout section is provided in the bottom wall, and wherein the feeding section includes a preventing portion which prevents blowup of the sheet caused by blowout of the air from the air blowout section, at a position opposite to the bottom wall across the sheet.

2. The sheet takeout device according to claim 1, wherein at least one of the first air blowout portion and the second air blowout portion is provided so that the air is blown out from a corner portion of the sheet of a minimum size in the one side of the sheet of a minimum size toward the center of gravity of the sheet of a minimum size.

3. The sheet takeout device according to claim 1, wherein the air blowout section blows out the air so that a moment given to the sheet of a minimum size by the air becomes 0.

4. The sheet takeout device according to claim 1, wherein the preventing portion is configured to blow out the air toward the sheet.

5. A sheet processing apparatus, comprising:

a sheet takeout device including:

a feeding section having a bottom wall with which one sides of a plurality of stacked sheets come in contact using own weights of the relevant sheets, which holds the plurality of sheets;

a takeout section which takes out the tipmost sheet by suction from the plurality of sheet held in the feeding section, and sends out the tipmost sheet in a sending direction; and an air blowout section which blows out air toward between the one side of the sheet to be sucked by the takeout section and the one side of the sheet next to the sheet to be sucked;

wherein the air blowout section including at least a first air blowout portion which is arranged at a position corresponding to a forward portion of the sheet in the sending direction, and a second air blowout portion which is arranged at a position corresponding to a backward portion of the sheet in the sending direction, wherein the air blowout section is provided in the bottom wall, and wherein the feeding section includes a preventing portion which prevents blowup of the sheet caused by blowout of the air from the air blowout section, at a position opposite to the bottom wall across the sheet;

a sending section which sends out the sheet taken out by the sheet takeout device; and a sorting processing section which perform sorting processing of the sheet sent out by the sending section.

* * * * *